US006468127B1

(12) United States Patent
Lee

(10) Patent No.: US 6,468,127 B1
(45) Date of Patent: Oct. 22, 2002

(54) TOY VEHICLE WITH WIRELESS BATTERY SWITCH

(75) Inventor: Keung Lee, New Territories (HK)

(73) Assignee: New Bright Industrial Co., Ltd., Kowloon (HK)

( * ) Notice: Subject to any disclaimer, the term of this patent is extended or adjusted under 35 U.S.C. 154(b) by 0 days.

(21) Appl. No.: 09/977,493

(22) Filed: Oct. 16, 2001

(51) Int. Cl.[7] ..... A63H 29/00
(52) U.S. Cl. ..... 446/457; 446/484; 361/730
(58) Field of Search ..... 446/454, 457, 446/462, 465, 441, 484; 200/17 R; 361/730

(56) References Cited

U.S. PATENT DOCUMENTS

| | | | | |
|---|---|---|---|---|
| 2,259,106 A | | 10/1941 | Hager | |
| 3,450,908 A | * | 6/1969 | Mabuchi | |
| 3,935,665 A | * | 2/1976 | Tong | 46/91 |
| 3,971,158 A | | 7/1976 | Hanson | |
| 4,013,907 A | * | 3/1977 | Mabuchi | 310/50 |
| 4,176,263 A | | 11/1979 | Rousseau | |
| 4,422,131 A | | 12/1983 | Clanton et al. | |
| 4,438,589 A | * | 3/1984 | Matsushiro | 46/251 |
| 4,697,133 A | * | 9/1987 | Pergandis | 320/2 |
| 4,748,544 A | | 5/1988 | Ince | |
| 5,268,818 A | * | 12/1993 | Itou | 361/730 |
| 5,295,882 A | | 3/1994 | McDermott | |
| 5,590,951 A | | 1/1997 | Matthews | |
| 5,895,328 A | | 4/1999 | Pahio | |

* cited by examiner

*Primary Examiner*—Derris H. Banks
*Assistant Examiner*—Jamila Williams
(74) *Attorney, Agent, or Firm*—Nixon & Vanderhye P.C.

(57) ABSTRACT

A wireless power control system for a motorized toy vehicle which includes a lever mechanism that physically moves a battery into and out of contact with the vehicle motor, thereby enabling selective operation of the toy without the need for electrical wiring. A spring mechanism is used at one end of the battery compartment to contact one terminal of the battery and to the bias the battery into contact with the motor housing, thereby providing electrical contact between one end of the battery and the motor. A rod element is used to contact the spring element and the other terminal of the motor to complete the electrical connection between the battery and the motor. The lever mechanism is selectively used to turn on and off the toy vehicle without the need for electrical wiring or an electrical switch.

15 Claims, 8 Drawing Sheets

TOY VEHICLE WITH WIRELESS BATTERY SWITCH

FIELD OF THE INVENTION

The instant invention is directed to battery switches for motorized toys, such as toy boats, cars, trucks motorcycles and the like. More particularly, the invention provides an improved battery switch for toys that requires no electrical wiring for activation of the motor that powers the toy. The invention uses a lever mechanism which enables the user to selectively turn on and off the toy by physically moving the battery into and out of contact with the motor, thereby selectively completing or opening the electrical circuit for power activation or deactivation, respectively.

BACKGROUND AND SUMMARY OF THE INVENTION

Toy vehicles have proven to be very popular toys for children of all ages. Many different types of toy vehicles have been provided in the past. For example, toy vehicles have been provided in the form of toy boats, toy cars, toy trucks, toy construction equipment, toy motorcycles and the like. Toy manufacturers are constantly trying to find ways to improve the operation of the toys so that they look and function in a manner that is as real as possible. In fact, many toys are made as miniaturized replicas of real full-size vehicles. Many such toys also include battery-driven motors that enable the toy to be self-propelled, thereby providing greater realism and further enjoyment for the user. Such battery driven toys have been provided with relatively complex and/or expensive power switching circuits and electrical elements for controlling the On and Off state of the toy. Toy manufacturers are constantly looking for ways to make the toys less expensive and more reliable. One problem with prior toy vehicles is that the power switching circuit includes electrical components, such as wiring and electrical switches that can be relatively complex, expensive, difficult to assemble, and/or subject to damage or failure. Thus, a need exists for an improved battery switch for toy vehicles that overcomes these and other disadvantages of the prior art.

In other areas of technology, such as flash light or signal light construction, others have provided various systems for enabling wireless power switch operation. Examples of such prior art systems are shown in U.S. Pat. No. 4,748,644 to Ince; U.S. Pat. No. 5,590,951 to Mathews; U.S. Pat. No. 4,422,131 to Clanton et al.; U.S. Pat. No. 5,295,882 to McDermott; U.S. Pat. No. 5,895,328 to Pahio; 3,971,158 to Hanson; U.S. Pat. No. 4,176,263 to Rousseau; and U.S. Pat. No. 2,259,106 to Hager. However, none of these prior systems are particularly designed or particularly suited for use in connection with toy vehicles. Thus, a need exists for an improved wireless battery switch particularly designed for use in connection with battery-driven toy vehicles.

The instant invention satisfies this need by providing a wireless battery switch particularly constructed for toy vehicles that is inexpensive, reliable, durable and easy to manufacture and assemble. In accordance with the invention, a lever mechanism is used to physically move the battery into and out of contact with the vehicle motor, thereby enabling selective operation of the toy without the need for electrical wiring. A spring mechanism is used at one end of the battery compartment to contact one terminal of the battery and to the bias the battery into contact with the motor housing, thereby providing electrical contact between one end of the battery and the motor. A rod element, such as a stainless steel rod is used to contact the spring element and the other terminal of the motor to complete the electrical connection between the battery and the motor. Thus, the lever mechanism can be selectively used to turn on and off the toy vehicle without the need for electrical wiring or an electrical switch. The particular combination of parts used in accordance with the instant invention to provide the wireless battery switch for a toy vehicle provide a very reliable, inexpensive and convenient power control system for toy vehicles.

In accordance with a main aspect of the instant invention, a wireless switching system for a motorized toy vehicle is provided which includes a vehicle housing having an electrical motor housed therein and operatively connected with a propulsion system for self-propelling the vehicle when the motor is energized. A battery compartment is provided within the vehicle housing and is adapted to receive a battery of a type having first and second terminals at opposite ends thereof. The battery compartment has a length that is greater than a length of the battery, thereby enabling the battery to move longitudinally within the battery compartment between first and second positions. The motor and the battery compartment are arranged such that the motor is positioned adjacent one end of the battery compartment. The battery can move longitudinally in the battery compartment to a first position wherein the first terminal of the battery makes direct electrical contact with the motor. A conductive spring element is positioned at an end of the battery compartment remote from the motor and adapted to make electrical contact with the second terminal of the battery and to apply a first force to the battery sufficient to cause the battery to move into the first position. A conductive rod element is used to make electrical contact with the spring element and with a terminal of the motor, thereby providing an electrical connection between the second terminal of the battery and the motor. When the battery is in the first position the motor is energized by the battery and the toy vehicle operates. The system further includes a switching element arranged to enable a user to selectively move the switching element between on and off positions, wherein when the switching element is moved to the off position, the switching element applies a second force to the battery that moves the battery to a second position within the battery compartment wherein the first terminal of the battery is out of electrical contact with the motor, thereby stopping operation of the motor. When the switching element is in the on position, the spring element is free to force the battery into the first position to cause the motor to be energized by the battery. In other words, the force applied to the battery by the switching element when moved to the off position, is greater than the opposing force applied by the spring element. As a result, the switching element causes the battery to move out of electrical contact with the motor when switched to the off position.

BRIEF DESCRIPTION OF THE DRAWINGS

Other objects, features and advantages of the instant invention will become apparent from the following detailed description of the invention when read in conjunction with the appended drawings, in which.

DETAILED DESCRIPTION OF THE INVENTION

Figure 1:
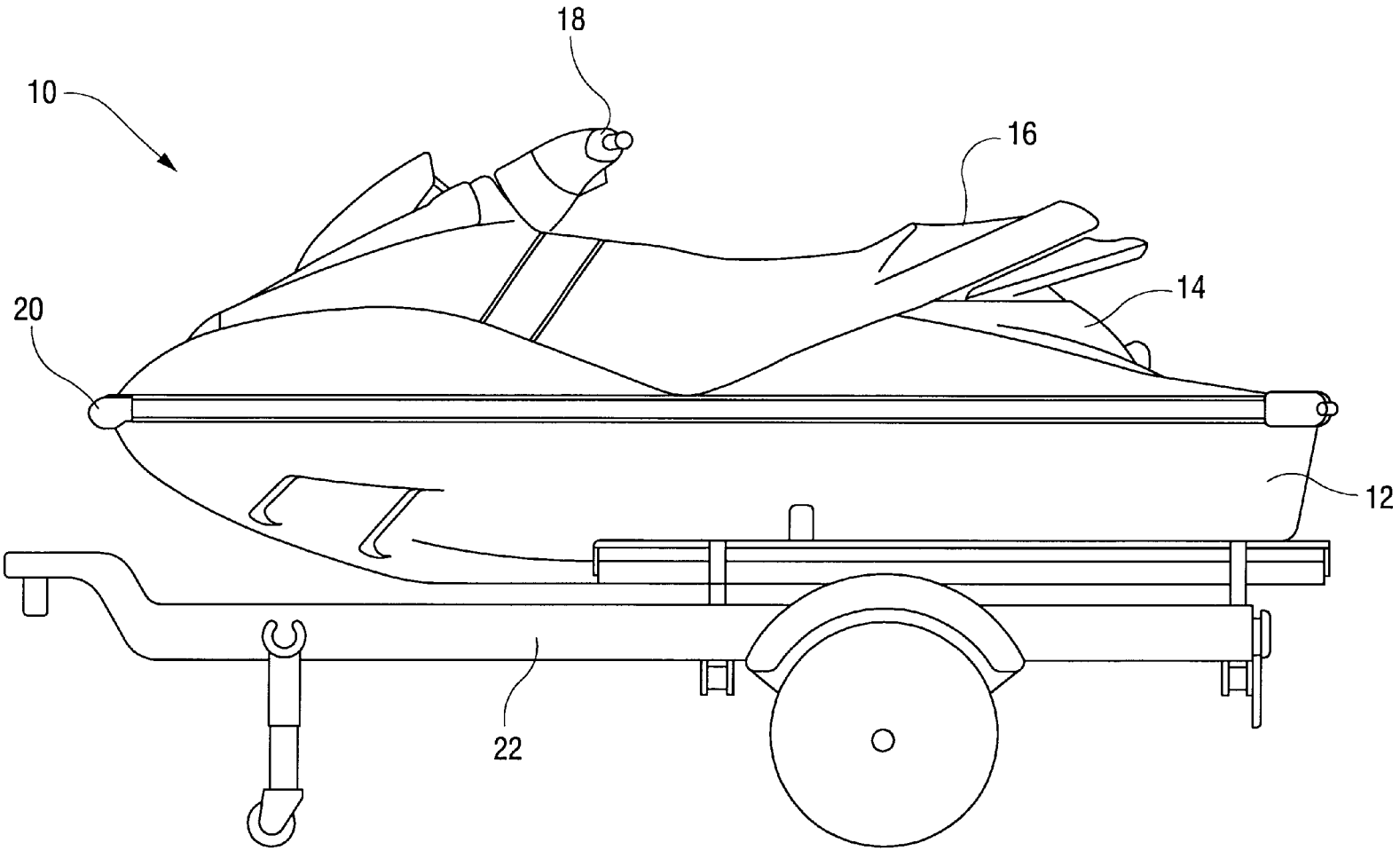
FIG. 1 is side view of an exemplary toy boat or watercraft, in the form of a Jet Ski, having the wireless battery switch of the instant invention incorporated therein.

The preferred embodiments of the instant invention will now be described with reference to the drawings. The embodiments described are only exemplary and are not meant to limit the scope of the invention beyond the express scope of the appended claims. In connection with the drawings, like reference numerals represent similar parts throughout the various views.

FIG. 1 shows an exemplary toy watercraft 10 in the form of a personal watercraft, widely known as a "Jet Ski". The toy watercraft 10 includes a lower housing or hull section 12, an upper housing section 14, and a seating section 16, all preferably made from a suitable plastic or other material that enables the toy watercraft to float in water and be very durable. The seating section 16 includes a simulated steering mechanism or handle bar 18. A rubber gasket 20 is used to join the lower housing section and upper housing section together in a watertight and secure manner. A miniaturized motor (see, e.g., FIG. 4) is contained within the toy watercraft's housing for driving a propeller or jet drive for propelling the watercraft through the water when turned on, thereby providing a fun and exciting toy that simulates a real working watercraft. The watercraft may be remotely controlled by an operator using an appropriate wireless or wired transmitter. Alternatively, the watercraft may operate on its own once energized. For example, the watercraft could have a fixed jet drive that causes the watercraft to move in a preset direction, or the drive may be manually movable to a desired location by the user prior to energizing the toy.

The toy watercraft is preferably constructed and designed to simulate a real watercraft, such as a jet ski, boat or other type of watercraft, thereby providing a realistic but miniaturized toy watercraft that can be played with in water, such as in a bathtub, pool, pond, lake or other suitable body of water. FIG. 1 shows the toy watercraft 10 sitting on an optional toy watercraft trailer 22, that may be sold with the toy or as an accessory thereto.

The overall design and construction of toy watercrafts, such as that shown in FIG. 1, are generally known to those skilled in the art of toy design and manufacture. Thus, no further specific details regarding the particular watercraft itself will be provided herein, so as not to obscure the description of the wireless battery switch of the instant invention with unnecessary details. The remaining description herein will focus on the wireless battery switch itself and explain how the invention can be incorporated into watercraft toys as well as any other suitable battery-driven toy, such as toy cars, trucks, motorcycles or any other self-propelled or battery-driven toy.

Figure 2:
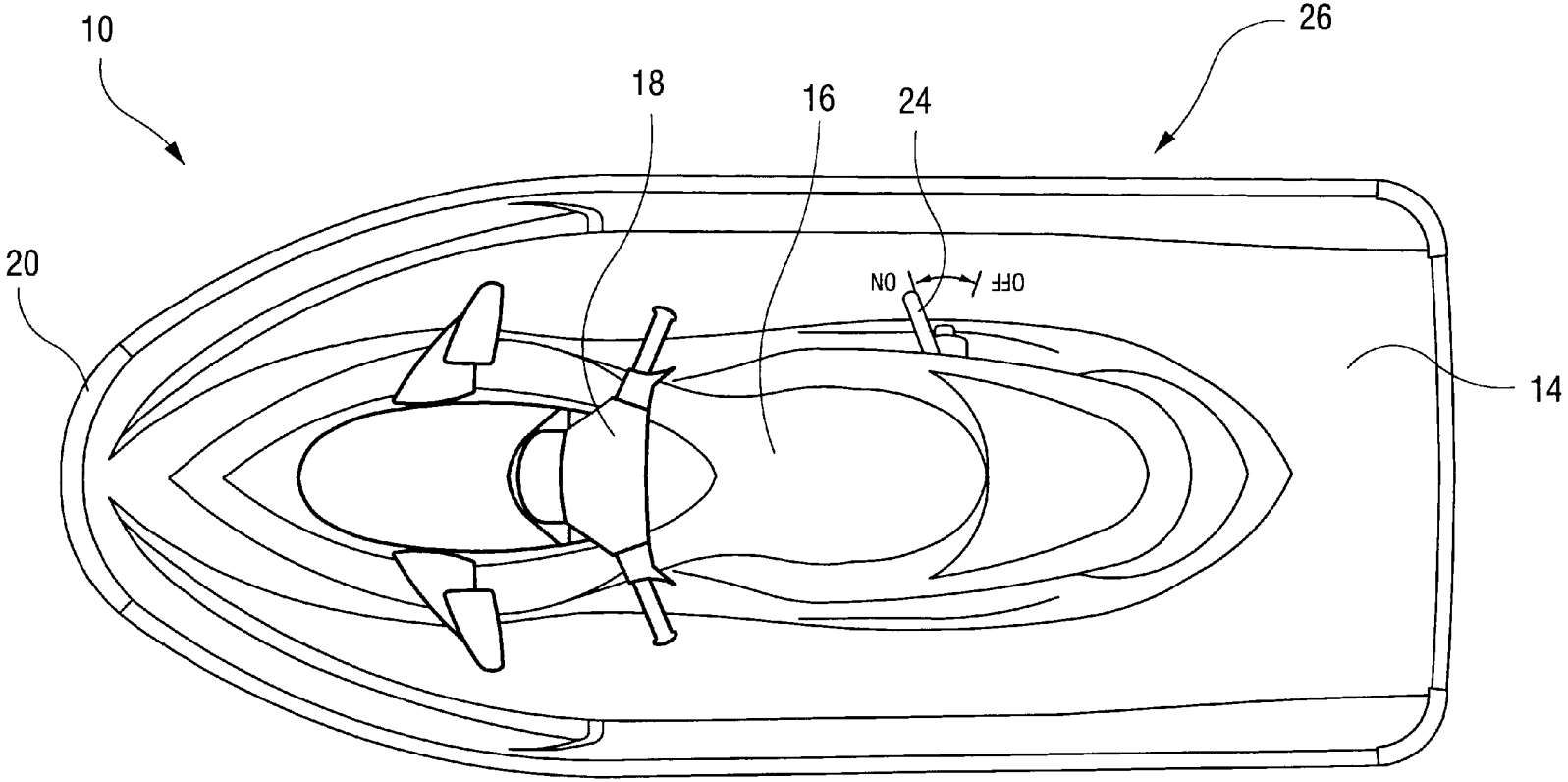
FIG. 2 is a top view of the toy watercraft of FIG. 1.

FIG. 2 shows a top view of the toy watercraft 10 of Fig. 1. On the right side 26 (i.e., upper side of FIG. 2) of the seating section 16 there is provided a preferred embodiment of the wireless power switch 24 of the instant invention. The switch 24 includes a working or lever end (see, e.g., FIG. 7) that extends out from the watercraft in a way that enables a user to selectively move the lever between an "On" and "Off" location. Wohen the switch 24 is in the Off position no power is provided to the motor housed in the watercraft for driving the watercraft. Thus, the watercraft does not operate when the switch is in the Off position. When the switch 24 is moved to the On position, an electrical circuit is completed (as will be described in detail below) and the motor is energized for driving the watercraft. Thus, the switch 24 provides a simple and convenient mechanism for turning on and off the watercraft toy. It is noted that the switch 24 could be located in any suitable location on the watercraft depending on the particular design thereof.

Figure 3:
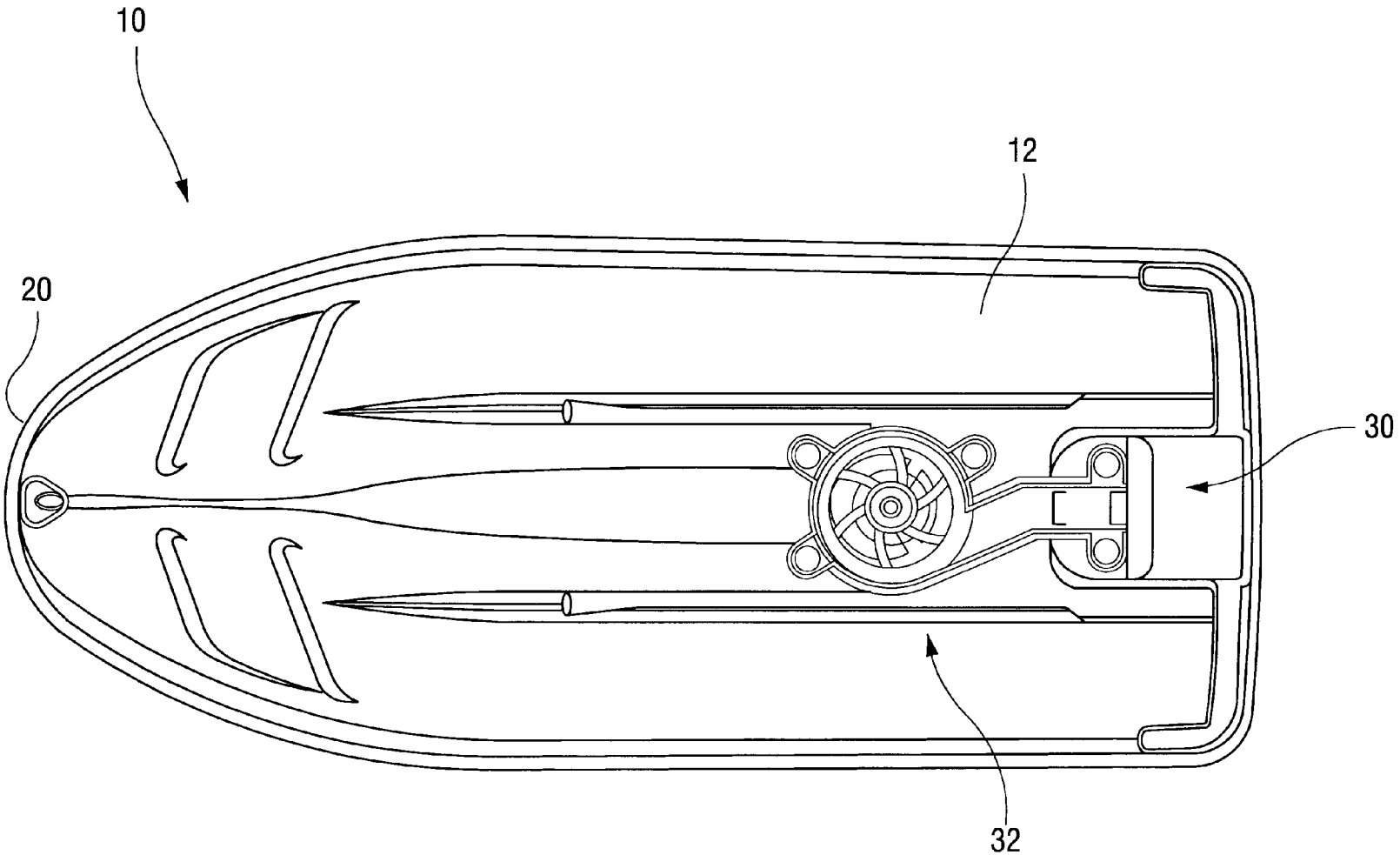
FIG. 3 is a bottom view of the toy watercraft of FIG. 2.

FIG. 3 shows a bottom view of the toy watercraft 10 of FIGS. 1 and 2. In this view, there is shown an exemplary jet impeller 32 and jet drive 30 for propelling the toy watercraft 10 when energized. The jet impeller is driven by the motor of the watercraft to drive the jet boat in accordance with known water-jet technology.

Figure 4:
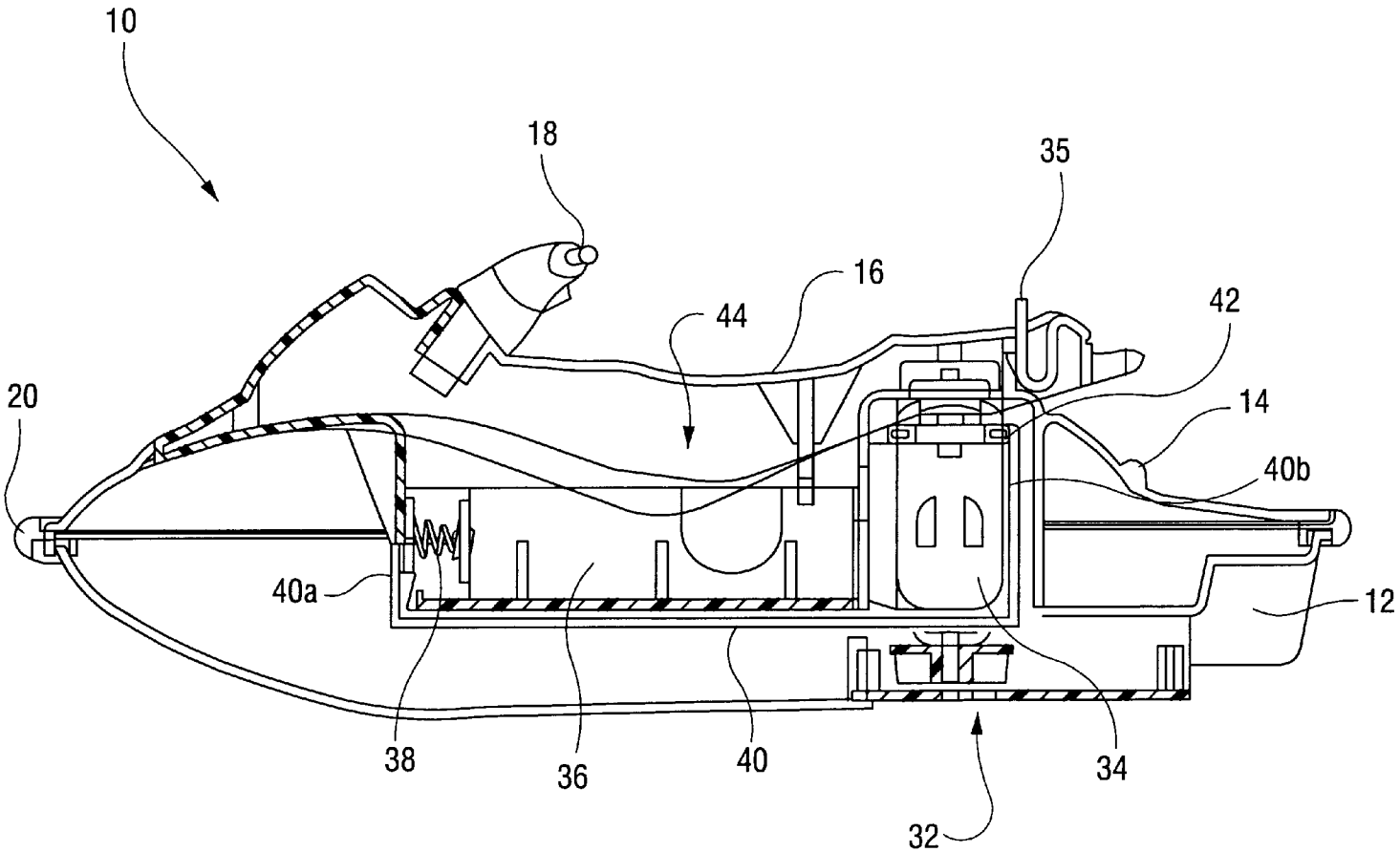
FIG. 4 is a side sectional view of the toy watercraft of FIG. 1.

FIG. 4 shows a side, sectional view of the toy watercraft 10, in which some of the main parts of the wireless battery switch of the instant invention can be seen. A miniaturized electric motor 34 is provided in the housing of the watercraft 10 and is operatively connected to the jet impeller 32 for driving the jet impeller when the motor 34 is energized. A battery compartment 44 is also provided in the watercraft housing for holding a battery 36 having a suitable size and capacity for powering the motor in a manner that enables a desired level of performance from the watercraft. In accordance with the invention, the battery compartment 44 is slightly longer than the length of the battery 36 itself, thereby enabling the battery 36 to be selectively moved longitudinally within the battery compartment 44 in a way that selectively completes or opens the electrical circuit that powers the motor 34. In other words, the battery can move in the battery compartment in a manner that causes one of the battery terminals to go into or out of contact with a contact terminal. The instant invention has particular applicability in this embodiment to toy watercrafts designed to use a conventional type of battery having its respective negative and positive terminals at opposite ends of the battery, such as a conventional 1.5 volt battery.

As seen in FIG. 4, in this embodiment of the instant invention, a conductive spring element 38 is provided on the end of the battery compartment that is remote from the motor 34. The spring element 38 is designed to contact the negative terminal of the battery 36 and to bias the battery 36 against the motor 34 such that the positive terminal of the battery 36 contacts the housing of the motor 34, thereby making an electrical connection between the motor and the positive terminal of the battery 36. In order to make an electrical connection between the negative terminal of the battery and the motor, to complete the electrical circuit, a stainless steel rod 40 or other suitable conductive rod element is provided. The rod 40 has a first end 40*a* that makes contact with the negative terminal spring element 38. The rod 40 also has a second end 40*b* that contacts the negative terminal of the motor, thereby completing the electrical circuit between the motor 34 and the battery 36. In this way, power from the battery 36 is provided to the motor 34 and the motor is energized to drive the watercraft 10. It is noted that FIG. 4 shows the position of the battery 36 in the battery compartment 44 when the switch 24 (see, e.g., FIG. 2) is in the On position (i.e., the battery is in contact with the negative spring element 38 (negative terminal) and the motor (positive terminal) thereby defining a complete electrical circuit that powers the motor 34.

Figure 5:
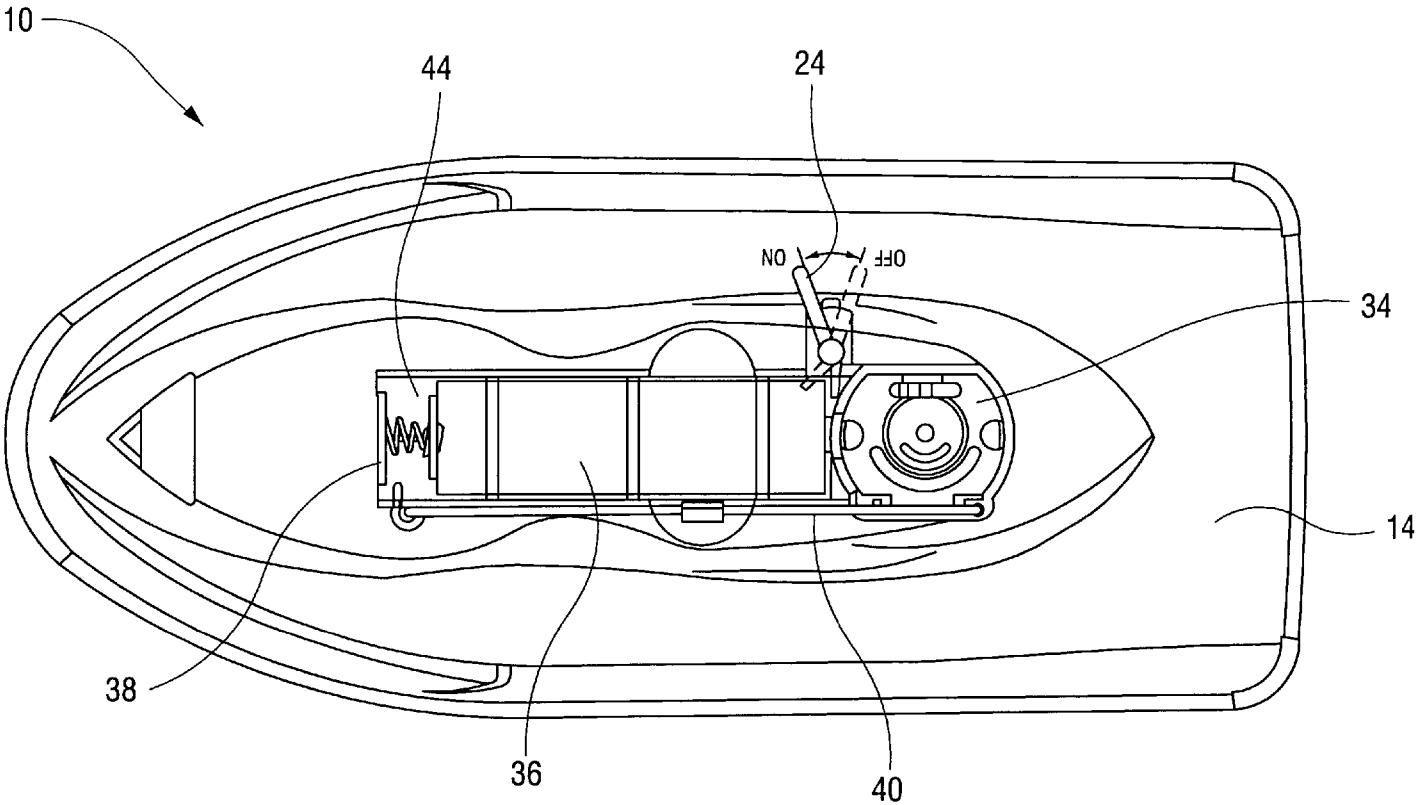
FIG. 5 is a top view of an upper housing section of the toy watercraft of FIG. 1 with the seat section removed to expose the battery compartment and showing a preferred embodiment of the wireless switching mechanism of the instant invention.

FIG. 5 shows a top view of the upper housing section 14 with the seat section 16 removed to open the battery compartment 44 and expose the battery 36. A clip mechanism, such as clip 35 shown in FIG. 4, can be used to enable the seat section 16 to be removed from the upper housing section 14. As shown in FIG. 5, the switching element can be selectively moved between the On and Off positions to selectively move the battery 36 into contact with or away from the housing of the motor 34. In FIG. 5, the battery is in the activated position or On position corresponding to the On position of the switch. The switch 24 is also shown with dotted lines in the Off position in FIG. 5. As will be explained in greater detail below, the switch element 24 includes an internal element that is designed to force the battery away from the motor and out of contact therewith when the switch is moved to the Off position. The switch is also designed such that the switch element 24 is able to hold the battery away from the motor against the opposing force being applied to the battery by the spring element 38. In this way, the toy can be securely placed in the Off condition and remain there until the user moves the switch to the On position, at which time the spring element 38 causes the battery 36 to be forced back into contact with the motor 34. The switch element is preferable designed such that no force is applied to the battery by the internal element thereof when the switch 24 is in the On position, thereby enabling the spring element 38 to freely press the positive terminal of the battery 36 against the motor 34.

Figure 6:
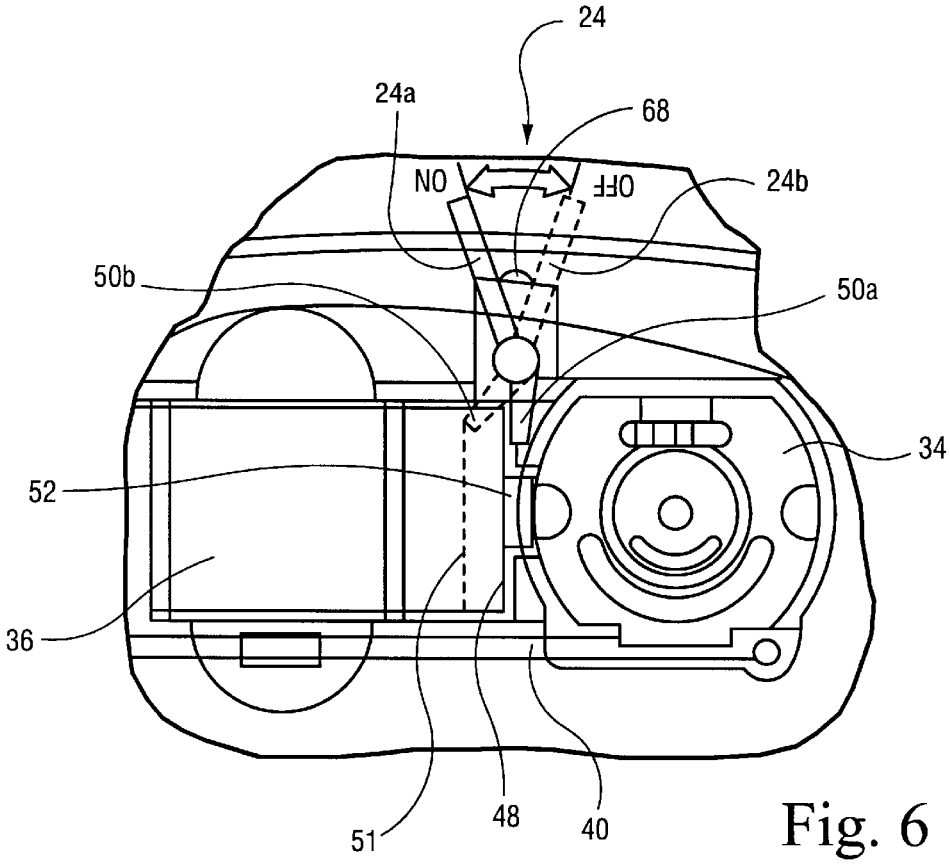
FIG. 6 is an enlarged partial view of the wireless switching mechanism of FIG. 5.

FIG. 6 shows an enlarged partial view of portion of the toy watercraft where the switch element 24, positive end 52 of the battery 36 and the motor 34 are located. FIG. 6 shows two positions for the switch element 24. More particularly, when the switch element 24 is in the position shown by reference numeral 24*a*, the internal element 50*a* thereof is rotated to a rearward position so that the battery is biased in the rearward position against the motor housing by the spring element 38 pressing against the negative terminal of the battery. However, when the switch element 24 is in the Off position as indicated by reference numeral 24*b*, the internal element 50*b* is rotated against the battery such that the battery is physically moved away from the location shown by numeral 48 to the forward location indicated by numeral 51. This movement of the battery causes the positive terminal 52 of the battery 36 to move away from and out of contact with the motor 34, thereby interrupting the electrical connection between the motor and the battery and stopping the motor. In this way, the switch element 24 can be easily and conveniently used to turn on and off the toy watercraft without the need for any wiring or an electronic switch.

Figure 7:
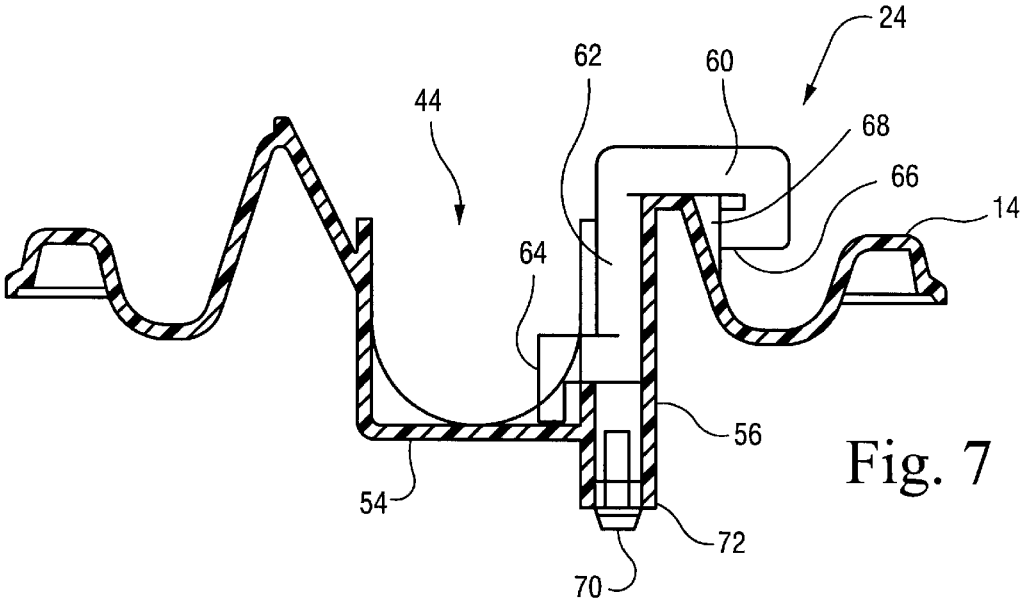
FIG. 7 is a partial sectional view of a preferred embodiment of the switching mechanism of the instant invention and showing its interconnection with the toy watercraft.

FIG. 7 shows a partial sectional view of the switch element 24 and its connection with the housing of the watercraft. As shown in FIG. 7, the upper watercraft housing 14 includes a mounting section 56 for receiving the switching element 24 therein. The switching element 24 includes an external portion 60 (corresponding to 24*a* or 24*b* above) that can be gripped by the user and manipulated into the On and Off positions. The external portion 60 is connected to a rotating shaft 62 that is rotatably mounted in the mounting section 56 of the housing 54. A lower end 70 of the rotating shaft 62 is held in position by an enlarged end portion thereof which is gripped to prevent removal by the bottom portion of section 56 once pushed out of the end 72 thereof. The external portion 60 of the switch element includes a lower portion 66 that is slightly flexible and resilient. This lower portion interacts with a protrusion 68, located in between the On and Off positions of the switch element, to securely keep the switch in the Off position. In other words, the lower portion 66 and protrusion 68 are structured such that their contact is sufficiently strong to keep the battery from being pushed rearwardly by the force of the spring element 38 until the user moves the switch element to the On position. The protrusion 68 also securely keeps the switch element in the On position, while also enabling the switch element to be easily moved but securely maintained in both the On and Off positions. The internal element 64 is connected to the rotating shaft 62 and is moved away and against the battery 36 in response to movement of the external element 60 between the On and Off positions. The external element 60, rotating shaft 62 and internal element 64 are preferably integrally formed as a single unit, such as a molded plastic element (see FIG. 10).

Figure 8:
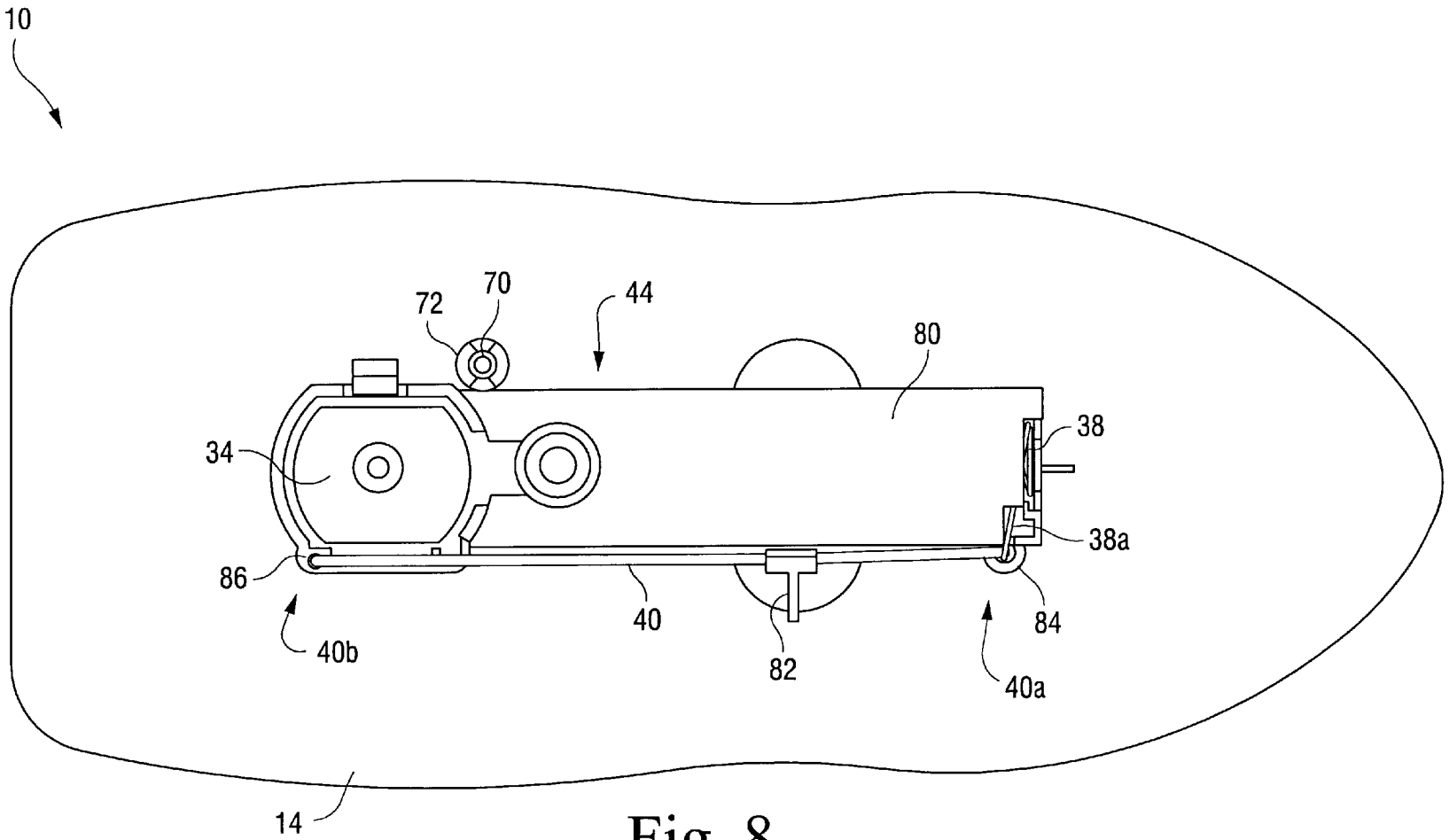
FIG. 8 is a simplified bottom view of the upper housing section of FIG. 5, in accordance with the preferred embodiment of the instant invention.

FIG. 8 shows a bottom view of the upper watercraft housing 14 of FIG. 5. As shown in FIG. 8, the spring element 38 has a leg portion 38*a* that contacts the first end 40*b* of the stainless steel rod 40. The first and second ends of rod 40 are inserted into respective openings 84 and 86 in the watercraft housing 14. The leg portion 38*a* of spring 38 preferably extends into the hole 84 with the first end 40*a* of the rod so that they are in close and secure contact in order to assure a good electrical connection therebetween. A rod holding element 82 is provided in order to securely maintain the rod 40 in the desired position as shown. The center portion of rod 40 extends along the side of the bottom 80 of the battery compartment 44. The second end 40*b* of the rod 40 extends into hole 86 and into contact with the negative terminal of the motor 34 which extends into an upper portion of the hole 80 at a location that enables the rod to contact the terminal. It is noted that the end 40*c* of the second end 40*b* of the rod 40 may have a taper so as to better contact the negative terminal 42 of the motor 34. Due to this connection of the negative battery terminal to the negative terminal of the motor provided by the spring element 38 and the rod 40, all that is needed to complete the circuit is to touch the battery against the motor housing. Thus, the switch 24 can then be used to selectively make this contact between the battery and the motor housing.

Figure 9:
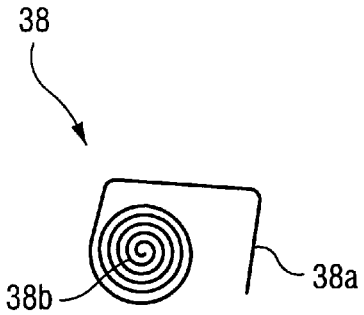
FIG. 9 is a plan view of a negative spring terminal used in accordance with a preferred embodiment of the wireless battery switch of the instant invention.

FIG. 9 shows a more detailed view of the conductive spring element 38 used to bias the battery against the motor housing and to connect the negative terminal of the battery with the rod 40. As shown in FIG. 9, the spring element 38 is mounted at the end of the battery compartment 44 and includes a main spring portion 38*b* designed to make good contact with the battery, and to provide a sufficient force to push the battery into contact with the motor when the switch is in the On position. The spring element 38 also includes a bent leg portion 38*a* that enables the spring element to extend into the hole 84 to make contact with the first end of the rod 40.

Figure 10:
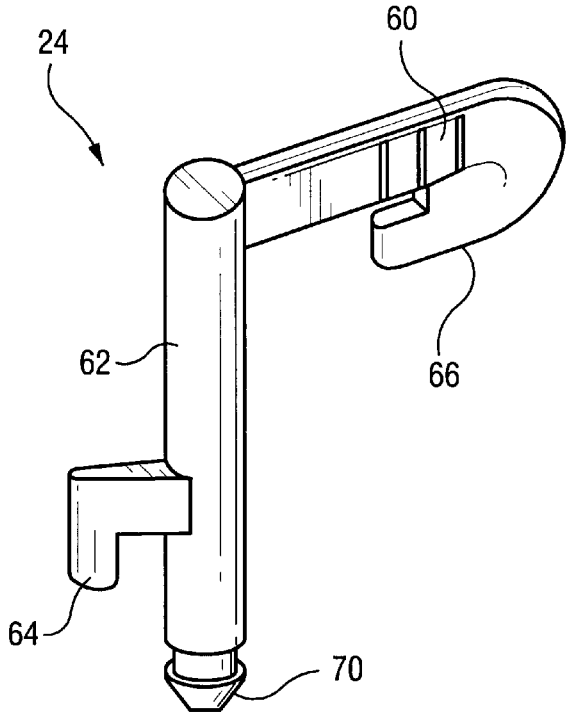
FIG. 10 is a perspective view of a lever mechanism used in accordance with a preferred embodiment of the wireless battery switch of the instant invention.

FIG. 10 shows a more detailed view of the switching element 24 prior to being installed in the watercraft housing. As explained above, the switch element 24 includes an external portion 60, a rotating shaft portion 62 and an internal battery-engaging portion 64. The external portion also includes the lower portion 66 or tab portion that has sufficient flexibility and/or resiliency such that it can interact with the protrusion 68 on the housing to enable secure (e.g., snap-like) operation of the switch between the On and Off positions. The end portion 70 is designed to hold the switching element 24 in its desired position in the housing in order to prevent the switch element from being pulled out of the housing with an upward force.

Figure 11:
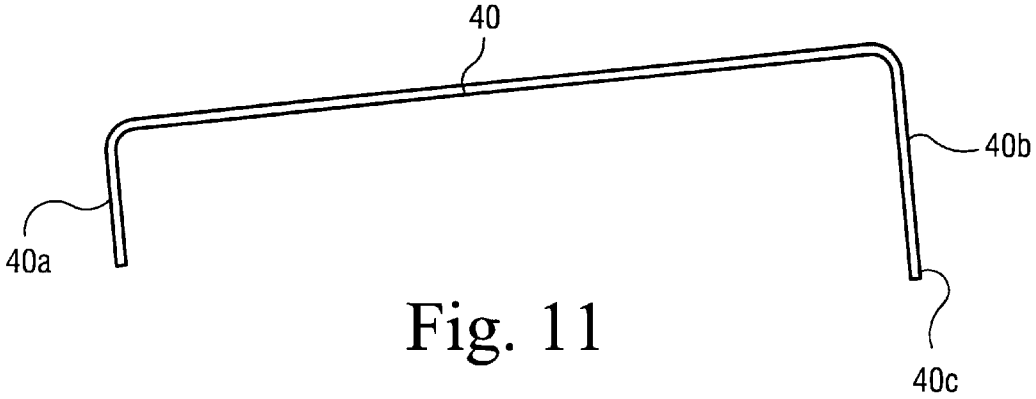
FIG. 11 is a plan view of a stainless steel rod used in accordance with a preferred embodiment of the wireless battery switch of the instant invention.

FIG. 11 shows a preferred embodiment of the rod 40 used in accordance with the instant invention. As seen in FIG. 11, and as described above, the rod 40 includes a main straight portion that extends from the spring element to the motor, as well as a pair of bent ends 40*a* and 40*b* designed to be inserted in respective openings 84 and 86 in the housing 14. The rod may be made of any suitable conductive rod material, such as stainless steel. The second end 40*b* of the rod 40 may include a slight taper on the end 40*c* thereof to provide a better connection with the negative terminal of the battery.

As can be seen from the above description, the instant invention provides a wireless battery switch that can be used in an easy, effective and inexpensive manner in connection with self-propelled toys. The instant wireless battery switch provides reliable operation without the disadvantages of having to use electrical wiring and/or other electronic elements that are subject to damage or failure. It is noted that the invention is not limited to water toys, but can be incorporated into any suitable toy device, such as toy cars, toy trucks, toy motorcycles, toy construction vehicles and the like.

While the preferred forms and embodiment of the instant invention have been illustrated and described herein, it will be appreciated by those skilled in the art that various changes and/or modifications can be made to the invention. Thus, the description herein is only exemplary and is not meant to limit the invention beyond express language of the appended claims.

What is claimed is:

1. A wireless switching system for a motorized toy vehicle, comprising:

a vehicle housing having an electrical motor housed therein and operatively connected with a propulsion system for self-propelling the vehicle when the motor is energized;

a battery compartment within the vehicle housing and adapted to receive a battery of a type having first and second terminals at opposite ends thereof, said battery compartment having a length that is greater than a length of said battery, thereby enabling the battery to move longitudinally within the battery compartment;

said motor and said battery compartment being arranged such that the motor is positioned adjacent one end of the battery compartment, wherein the battery can move longitudinally in the battery compartment to a first position wherein the first terminal of the battery makes direct electrical contact with the motor;

a conductive spring element positioned at an end of said battery compartment remote from said motor and adapted to make electrical contact with the second terminal of said battery and to apply a first force to the battery sufficient to cause said battery to move into said first position;

a conductive rod element having electrical contact with said spring element and with a terminal of the motor, thereby providing an electrical connection between the second terminal of the battery and the motor;

wherein when said battery is in said first position said motor is energized by said battery and said toy vehicle operates;

a switching element arranged to enable a user to selectively move said switching element between on and off positions, wherein when said switching element is moved to said off position, the switching element applies a second force to the battery that moves the battery to a second position within said battery compartment wherein the first terminal of the battery is out of electrical contact with the motor, thereby stopping operation of the motor, and further wherein when the switching element is in the on position, said spring element is free to force the battery into the first position to cause the motor to be energized by the battery.

2. The wireless switching system of claim 1, wherein said rod element includes a first bent end that makes contact with the spring element and a second bent end that makes contact with the terminal of the motor.

3. The wireless switching system of claim 2, wherein the vehicle housing includes a first hole for receiving said first bent end of said rod element and a second hole for receiving said second bent end of said rod element.

4. The wireless switching system of claim 3, wherein the spring element includes a leg portion that extends into the first hole where the leg element makes contact with the first bent end of the rod element.

5. The wireless switching system of claim 4, wherein a terminal of the motor extends into the second hole where the terminal makes contact with the second bent end of the rod element.

6. The wireless switching system of claim 1, wherein the switching element includes a first portion that extends externally of the vehicle for enabling a user to move the switching element between the on and off positions.

7. The wireless switching system of claim 6, wherein the switching element further includes a rotating shaft portion that is rotatably mounted in the vehicle housing.

8. The wireless switching system of claim 7, wherein the switching element further includes an internal element connected to said rotating shaft element, wherein the internal element is constructed and arranged such that the internal element contacts an end portion of the battery to force the battery to said second position in response to rotation of said rotating shaft portion by movement of said external portion.

9. The wireless switching system of claim 8, wherein the external element, rotating shaft element and internal element are integrally formed.

10. The wireless switching system of claim 9, wherein the external element, rotating shaft element and internal element are made of a plastic material.

11. The wireless switching system of claim 1, further including a protrusion located between the on and off positions of the switching element, said switching element including a resilient portion that interacts with said protrusion to maintain said switching element in the on and off position until a user moves the switching element.

12. The wireless switching system of claim 11, wherein the resilient portion is a tab portion that extends below the external portion of the switching element and interacts with the protrusion in a snapping manner when the switching element is switched between the on and off positions.

13. The wireless switching system of claim 1, wherein the vehicle housing includes a rod holding element for holding the rod element in position in the vehicle housing.

14. The wireless switching system of claim 1, wherein the toy vehicle is a watercraft.

15. The wireless switching system of claim 14, wherein the propulsion system is a water-jet propulsion system.

* * * * *